US006691731B1

(12) United States Patent
Thompson et al.

(10) Patent No.: US 6,691,731 B1
(45) Date of Patent: Feb. 17, 2004

(54) CORPORATION STOP CLEANING DEVICE

(76) Inventors: Jamie L. Thompson, 723 N. Main St., Mason City, IL (US) 62664; L. Wayne Dixon, 1108 E. Pine St., Mason City, IL (US) 62664

( * ) Notice: Subject to any disclaimer, the term of this patent is extended or adjusted under 35 U.S.C. 154(b) by 0 days.

(21) Appl. No.: 10/458,025

(22) Filed: Jun. 11, 2003

(51) Int. Cl.[7] ..... B08B 1/00; B08B 3/04; B08B 9/027; B08B 9/04; B08B 9/032

(52) U.S. Cl. ..... 137/245.5; 15/104.16; 15/104.18; 134/22.12; 134/166 C; 137/15.05; 137/15.06; 137/240; 137/244

(58) Field of Search ..... 15/104.05, 104.16, 15/104.18; 134/22.12, 166 C; 137/15.04, 15.05, 15.06, 240, 242, 244, 245.5

(56) References Cited

U.S. PATENT DOCUMENTS

| | | | | | |
|---|---|---|---|---|---|
| 1,015,915 | A | * | 1/1912 | Strickler | 15/104.18 |
| 1,069,013 | A | * | 7/1913 | Hinckley | 137/245.5 |
| 1,159,977 | A | * | 11/1915 | Massey et al. | 15/104.05 |
| 1,349,594 | A | * | 8/1920 | Wafer et al. | 137/242 |
| 1,435,647 | A | * | 11/1922 | McCanna | 15/104.18 |
| 1,553,034 | A | * | 9/1925 | Donnelly | 137/242 |
| 1,978,853 | A | | 10/1934 | Albright | |
| 2,806,237 | A | * | 9/1957 | Love | 15/104.18 |
| 3,432,872 | A | | 3/1969 | Kirschke | |
| 3,856,570 | A | | 12/1974 | McDermott | |
| 4,013,518 | A | | 3/1977 | Miko | |
| 4,192,342 | A | * | 3/1980 | Adams | 137/245.5 |
| 4,391,289 | A | * | 7/1983 | Adams | 137/245.5 |
| 4,393,535 | A | * | 7/1983 | Kunz | 15/104.18 |
| 4,656,685 | A | * | 4/1987 | Wood | 15/104.16 |
| 4,898,201 | A | * | 2/1990 | Conley et al. | 137/245.5 |
| 4,938,246 | A | * | 7/1990 | Conley et al. | 137/245.5 |
| 5,085,244 | A | * | 2/1992 | Funk | 137/240 |
| 5,322,571 | A | | 6/1994 | Plummer et al. | |
| 5,911,256 | A | | 6/1999 | Tsai | |
| 5,964,238 | A | * | 10/1999 | Junkin | 137/240 |
| 6,182,677 | B1 | * | 2/2001 | Pignataro | 137/15.05 |

* cited by examiner

*Primary Examiner*—George L. Walton
(74) *Attorney, Agent, or Firm*—Donald R. Schoonover

(57) ABSTRACT

A corporation stop cleaner device includes a T-shaped body having an inlet end, an outlet end, a flushing inlet connection and a flushing outlet connection. The T-shaped body is attached to the fluid inlet of a corporation stop. A removable brush is mounted on one end of a rigid rod and is forced through the T-shaped body and into the corporation stop. The brush abuts the inner surfaces of the corporation stop to remove debris or the like from the inner surfaces of the corporation stop. Flushing water flows through the T-shaped body to remove debris removed from the corporation stop. An optional pipe cleaning tool includes the T-shaped body attached to a service water line with an expandable brush mounted on one end of a flexible cable wherein the brush expands through the pipe cleaning tool inside of the water pipe to remove debris from the line that is stopping flow of water therethrough.

4 Claims, 2 Drawing Sheets

TO SERVICE LINE

CS
CSO
CSI

CORPORATION STOP CLEANING DEVICE

BACKGROUND OF THE INVENTION

1. Field of the Invention

The present invention relates to the general art of fluid handling, and to the particular field of servicing a pipe joint.

2. Discussion of the Related Art

A variety of circumstances exist in which it is desirable to form a junction or branch line from a main fluid-carrying conduit. For instance, in the municipal area, municipal fluid distribution systems include water mains, and customer service lines connected to the mains for supplying individual customers. A similar need exists in other industries, such as in the chemical pipeline industry. Most of the service lines are installed after the main line is in service. Therefore, a need exists to install service lines while the main conduit is carrying fluid under pressure.

Fittings for connecting service lines to mains usually incorporate a valve therein, called a corporation stop valve, and the assembly of the valve and fitting is called a corporation stop assembly. Such connections, however, may also be called service tees, elbows or straight transition fittings. In the past where such fittings have been used with cast iron or steel pipe, the inlet portion of the fitting was made with a tapered thread that cooperated with threads in a tapped hole in the main.

Some corporation stops are not cleaned out for years, if ever. Accordingly, debris and products associated with the fluid flowing through the corporation stop can accumulate in the stop. Such debris and products will reduce the flow efficiency of the corporation stop, if not clog it completely.

Therefore, there is a need for a device for cleaning a corporation stop.

Presently, once a corporation stop has become so clogged as to be unacceptably inefficient, or completely clogged, the stop must be replaced. This is often a time consuming and expensive operation. For this reason, some property owners delay servicing an otherwise inefficient corporation stop. The inefficiency will continue thereby costing the property owner money. Thus, when a corporation stop becomes clogged, it is most effective if the clogging can be removed, or at least relieved, as quickly as possible.

Therefore, there is a need for a device for efficiently cleaning a corporation stop.

Since corporation stops are used in a wide variety of situations, these stops often have various size fittings and couplings. In order to be most efficient in cleaning such an element, any cleaning device must be adaptable for use with a wide variety of elements.

Therefore, there is a need for a device for cleaning a corporation stop that is adaptable to a variety of different fittings associated with corporation stops.

PRINCIPAL OBJECTS OF THE INVENTION

It is a main object of the present invention to provide a device for cleaning a corporation stop.

It is another object of the present invention to provide a device for cleaning a corporation stop that is adaptable to a variety of different fittings associated with corporation stops.

It is another object of the present invention to provide a device for efficiently cleaning a corporation stop.

SUMMARY OF THE INVENTION

These, and other, objects are achieved by a corporation stop cleaning unit which includes a removable brush head on one end of a rigid rod with a handle on the other end of the rod. The brush head is removable for various sizes and abuts any surface adjacent thereto as the brush head is forced through the corporation stop.

In use, a pipe connecting the corporation stop to a service line is removed, the corporation stop is shut off and the corporation stop cleaner device embodying the present invention is connected to the inlet of the corporation stop. A flushing hose is connected to the corporation stop cleaner device and is routed away from the cleaning area. The corporation stop is then opened and the cleaning brush is forced through the corporation stop to loosen debris from the corporation stop. During the process, water and debris are flushed out and away from the work area by way of the flushing hose.

Using the system and method embodying the present invention saves a water company from having to tap the main and insert a new corporation stop.

BRIEF DESCRIPTION OF THE DRAWING FIGURES

DETAILED DESCRIPTION OF THE PREFERRED EMBODIMENT

Other objects, features and advantages of the invention will become apparent from a consideration of the following detailed description and the accompanying drawings.

Figure 1:
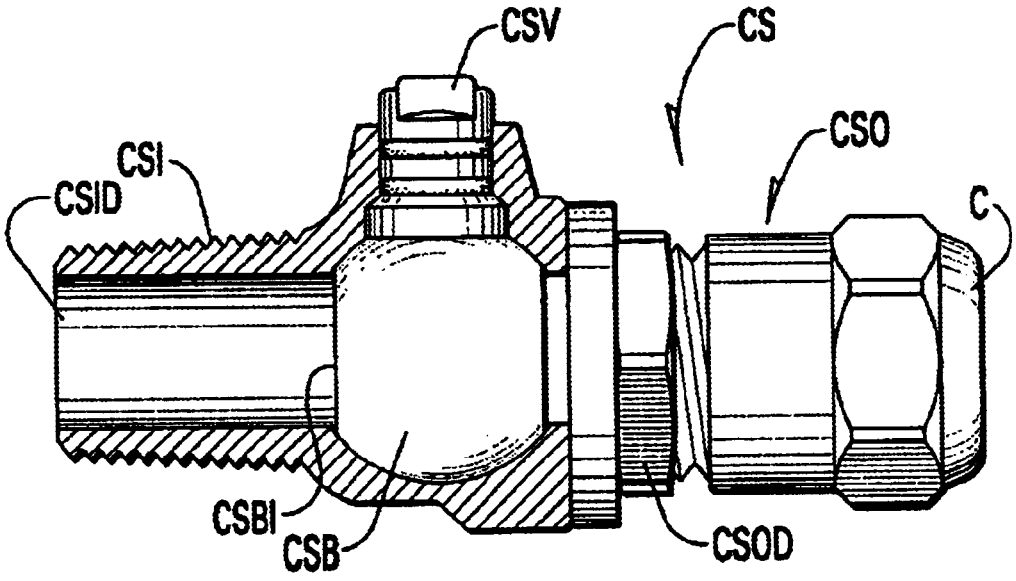
FIG.1 PRIOR ART
FIG. 1 shows a corporation stop.
Figure 2:
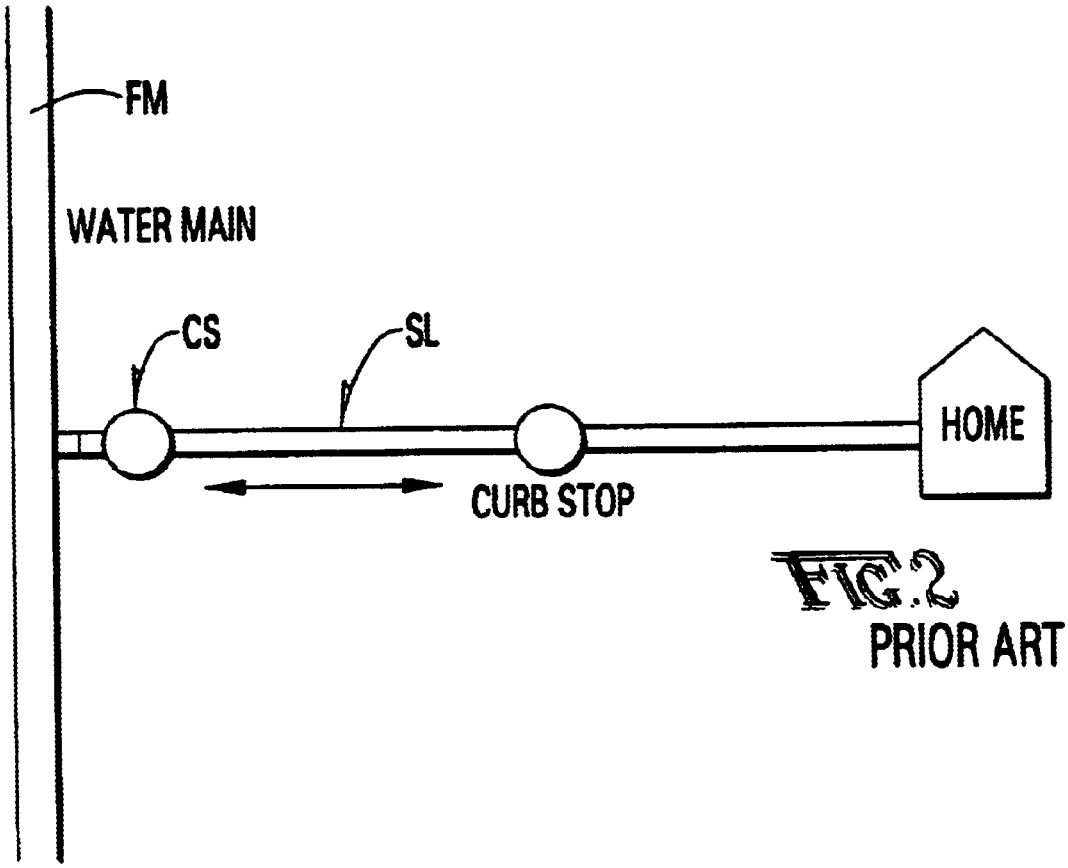
FIG.2 PRIOR ART
FIG. 2 shows a connection between a user and a main fluid line via a service line and via a corporation stop.

By way of reference, a corporation stop CS is shown in FIG. 1. As indicated in FIG. 2, a corporation stop is used to connect service lines SL (fluid lines to a user location, such as a home) to fluid mains FM (large diameter conduits that supply fluid from a main source, such as a public utility). The corporation stop includes an inlet CSI which is inserted into a main FM, a shutoff valve CSV and an outlet CSO which is fluidically connected to a service line SL to the user location. A coupling C is used to mechanically connect the corporation stop to the service line.

Referring next to FIGS. 3 through 5B, it can be understood that the present invention is embodied in a corporation stop cleaning unit 10. Unit 10 comprises corporation stop CS which includes a hollow body CSB with the hollow body having an interior dimension CSBI. Fluid inlet CSI is fluidically connected to the body and is fluidically connected to main fluid line FM when the corporation stop is in use. The fluid inlet has an interior dimension CSID. Fluid outlet CSO is fluidically connected to the body and is fluidically connected to service fluid line SL when the corporation stop is in use. The fluid outlet has an interior dimension CSOD and is aligned with the fluid inlet.

Shutoff valve CSV is fluidically interposed between the fluid inlet of the corporation stop and the fluid outlet of the corporation stop.

A cleaning unit 20 includes a hollow T-shaped body 22 which has an inlet end 24, an outlet end 26 which is collinear with the inlet end 24 of the T-shaped body 22, a flushing inlet connection 28 and a flushing outlet connection 30 which is collinear with the flushing inlet connection 28 and which is perpendicular to the inlet end 24 of the T-shaped body 22.

A fitting unit 40 releasably couples the outlet end 26 of the T-shaped body 22 to the fluid inlet CSI of the corporation stop CS in the use condition of the cleaning unit 20. The fitting unit 40 includes a plurality of couplings so various sizes of corporation stops can be accommodated.

A flushing hose 50 is fluidically connected to the flushing inlet connection 28 of the T-shaped body 22 in the use condition of the cleaning unit 20, and is also fluidically connected to a source (not shown) of flushing water.

A coupling element 52 is on the flushing outlet connection 30 of the T-shaped body 22.

A cleaning tool 60 extends through the T-shaped body 22 from the inlet connection 24 of the T-shaped body 22 through the outlet connection 26 of the T-shaped body 22 in the use condition of the cleaning unit 20 and in a use condition of the cleaning tool 60.

The cleaning tool includes a rigid rod 62 and an outer casing 64 surrounding the rigid rod 62. The outer casing 64 has an outer dimension 66. A handle 68 is located on one end of the rigid rod 62.

Figures 3, 4, 5A, 5B:
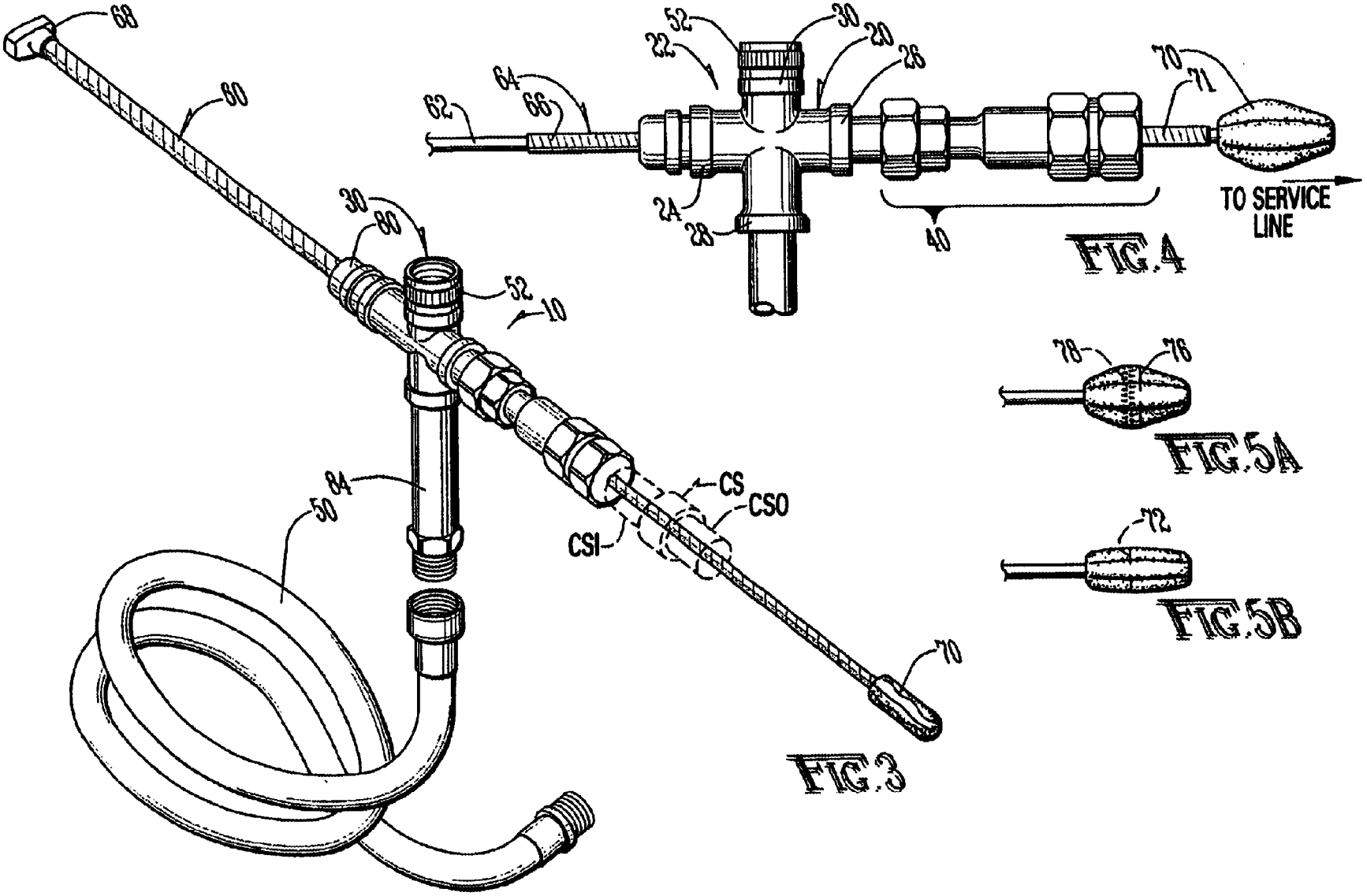
FIG. 3 is a perspective view of corporation stop cleaning unit embodying the present invention in place in a corporation stop.
FIG. 4 is a side elevational view of a portion of an optional service line cleaning kit of the corporation stop cleaning unit in place in a corporation stop.
FIG. 5A shows the cleaning brush head in a first condition with a first outer dimension.
FIG. 5B shows the cleaning brush head in a second condition with a second outer dimension.

A removable cleaning brush head 70 is located on a second end 71 of the rigid 62. The cleaning brush 70 has a first outer dimension 72 which is shown in FIG. 5B and which is greater than the outer dimension 66 of the outer casing 64 of the cleaning tool 60 and a second outer dimension 76 which is shown in FIG. 5A and which is greater than the interior dimension of the hollow body of the corporation stop or the interior dimension of the fluid inlet of the corporation stop or the interior dimension of the fluid outlet of the corporation stop. The brush head 70 is movable between the first outer dimension 72 and the second outer dimension 76. The brush head 70 further includes a biasing element 78, such as a sponge-type element or a spring, or the like, in the brush head 70 which biases the brush head 70 toward the second outer dimension 76. In this manner, the brush head 70 will brush against any surface located adjacent thereto. This brushing action will clean debris or the like from the corporation stop as the brush head 70 is moved back and forth inside the corporation stop. As the brush 70 is moved back and forth in the corporation stop, flushing water flows through the cleaning unit 20 and flushes away debris or the like that is loosened by the brushing action. The debris or the like thus flushed from the corporation stop will be carried away by the flushing water to a suitable destination.

A rubber grommet 80 can be located on the inlet end 24 of the body 22 of the cleaning unit 20, and an extension conduit 84 can be fluidically connected to the flushing inlet connection 28 of the T-shaped body 22 of the cleaning unit 80.

As can be understood from the teaching of the foregoing disclosure, the present invention 10 is also embodied in a method which comprises: disconnecting a corporation stop from a main; providing cleaning unit 20; forcing cleaning brush 70 through the inlet end 24 of the T-shaped body 22 of the cleaning unit 20; forcing cleaning brush 70 through the T-shaped body 22 of the cleaning unit 20; forcing cleaning brush 70 through the outlet end 26 of the T-shaped body 22 of the cleaning unit 20; forcing cleaning brush 70 through the fluid inlet of the hollow body of the corporation stop; forcing cleaning brush 70 through the hollow body of the corporation stop; forcing cleaning brush 70 through the fluid outlet of the hollow body of the corporation stop; and allowing the removable cleaning brush head 70 to expand toward the second outer dimension 76 and abut any structure adjacent to the cleaning brush head 70 as the brush is forced through the fluid inlet of the hollow body of the corporation stop, the hollow body of the corporation stop and the fluid outlet of the hollow body of the corporation stop.

It is understood that while certain forms of the present invention have been illustrated and described herein, it is not to be limited to the specific forms or arrangements of parts described and shown.

What is claimed and desired to be covered by Letters Patent is:

1. A corporation stop cleaner unit comprising:

a) a corporation stop which includes (1) a hollow body, the hollow body having an interior dimension, (2) a fluid inlet fluidically connected to the body and fluidically connected to a main fluid line when said corporation stop is in use, the fluid inlet having an interior dimension, (3) a fluid outlet fluidically connected to the body and fluidically connected to a service fluid line when said corporation stop is in use, the fluid outlet having an interior dimension and being aligned with the fluid inlet, (4) a shutoff valve fluidically interposed between the fluid inlet of said corporation stop and the fluid outlet of said corporation stop; and b) a cleaning unit which includes (1) a hollow T-shaped body having an inlet end, an outlet end which is collinear with the inlet end of the T-shaped body, a flushing inlet connection and a flushing outlet connection which is collinear with the flushing inlet connection and which is perpendicular to the inlet end of the T-shaped body, (2) a fitting unit which releasably couples the outlet end of the T-shaped body to the fluid inlet of said corporation stop in the use condition of said cleaning unit, (3) a flushing hose fluidically connected to the flushing inlet connection of said T-shaped body in the use condition of said cleaning unit, (4) a coupling element on the flushing outlet connection of the T-shaped body, and (5) a cleaning tool which extends through the T-shaped body from the inlet connection of the T-shaped body through the outlet connection of the T-shaped body in the use condition of said cleaning unit and in a use condition of the cleaning tool, the cleaning tool including (A) a rigid rod, (B) an outer casing surrounding the rigid rod, the outer casing having an outer dimension, (C) a handle on one end of the rigid rod, and (D) a removable cleaning brush head on a second end of the rigid rod, the removable cleaning brush having a first outer dimension which is greater than the outer dimension of the outer casing of said cleaning tool and a second outer dimension which is greater than the interior dimension of the hollow body of said corporation stop or the interior dimension of the fluid inlet of said corporation stop or the interior dimension of the fluid outlet of said corporation stop, the brush head being movable between the first outer dimension and the second outer dimension, the brush head further including a biasing element in the brush head biasing the brush head toward the second outer dimension.

2. The corporation stop cleaner as described in claim 1 further including a rubber grommet on the inlet end of the body of said cleaning unit.

3. The corporation stop cleaner as described in claim 2 further including an extension conduit fluidically connected to flushing inlet connection of the T-shaped body of said cleaning unit.

4. A method of cleaning a corporation stop comprising:

a) disconnecting a corporation stop from a main, the corporation stop including a hollow body, the hollow body having an interior dimension, a fluid inlet fluidically connected to the body and fluidically connected to a main fluid line when said corporation stop is in use, the fluid inlet having an interior dimension, a fluid outlet fluidically connected to the body and fluidically connected to a service fluid line when said corporation stop is in use, the fluid outlet having an interior dimension and being aligned with the fluid inlet, a shutoff valve fluidically interposed between the fluid inlet of said corporation stop and the fluid outlet of said corporation stop;

b) providing a cleaning unit which includes a hollow T-shaped body having an inlet end, an outlet end which is collinear with the inlet end of the T-shaped body, a flushing inlet connection and a flushing outlet connection which is collinear with the flushing inlet connection and which is perpendicular to the inlet end of the T-shaped body, a fitting unit which releasably couples the outlet end of the T-shaped body to the fluid inlet of said corporation stop in the use condition of said cleaning unit, a flushing hose fluidically connected to the flushing inlet connection of said T-shaped body in the use condition of said cleaning unit, a coupling element on the flushing outlet connection of the T-shaped body, and a cleaning tool which extends through the T-shaped body from the inlet connection of the T-shaped body through the outlet connection of the T-shaped body in the use condition of said cleaning unit and in a use condition of the cleaning tool, the cleaning tool including a rigid, an outer casing surrounding the rigid rod, the outer casing having an outer dimension, a handle on one end of the rigid rod, and a removable cleaning brush head on a second end of the rigid rod, the removable cleaning brush including a first outer dimension which is greater than the outer dimension of the outer casing of said cleaning tool and a second outer dimension which is greater than the interior dimension of the hollow body of said corporation stop or the interior dimension of the fluid inlet of said corporation stop or the interior dimension of the fluid outlet of said corporation stop, the brush head being movable between the first outer dimension and the second outer dimension, the brush head further including a biasing element in the brush head biasing the brush head toward the second outer dimension;

c) forcing the cleaning brush through the inlet end of the T-shaped body of the cleaning unit;

d) forcing the cleaning brush through the T-shaped body of the cleaning unit;

e) forcing the cleaning brush through the outlet end of the T-shaped body of the cleaning unit;

f) forcing the cleaning brush through the fluid inlet of the hollow body of the corporation stop;

g) forcing the cleaning brush through the hollow body of the corporation stop, h) forcing the cleaning brush through the fluid outlet of the hollow body of the corporation stop;

i) allowing the removable cleaning brush head to expand toward the second outer dimension and abut any structure adjacent to the cleaning brush head as the brush is forced through the fluid inlet of the hollow body of the corporation stop, the hollow body of the corporation stop and the fluid outlet of the hollow body of the corporation stop.

* * * * *